US006932121B1

(12) United States Patent
Shivers, III

(10) Patent No.: US 6,932,121 B1
(45) Date of Patent: Aug. 23, 2005

(54) METHOD FOR OFFLOADING AND STORAGE OF LIQUEFIED COMPRESSED NATURAL GAS

(75) Inventor: Robert Magee Shivers, III, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 10/903,446

(22) Filed: Jul. 30, 2004

Related U.S. Application Data

(60) Provisional application No. 60/508,892, filed on Oct. 6, 2003.

(51) Int. Cl.[7] ..... B65B 1/04

(52) U.S. Cl. ..... 141/1; 141/59; 141/82; 141/285; 299/6; 405/59; 62/53.1

(58) Field of Search ..... 141/1, 11, 59, 69, 141/70, 82, 285; 299/3, 6, 10; 405/52, 53, 405/59; 62/53.1

(56) References Cited

U.S. PATENT DOCUMENTS 6,582,025 B2 * 6/2003 Pickren ..... 299/6
6,813,893 B2 * 11/2004 Bishop et al. ..... 62/53.1

* cited by examiner

*Primary Examiner*—Timothy L. Maust
(74) *Attorney, Agent, or Firm*—Buskop Law Group, P.C.; Wendy Buskop

(57) ABSTRACT

A method for offloading and storage of liquefied compressed natural gas into a salt dome by using inserting displacement gas with a pressure greater than a pressure of the liquefied compressed natural gas and a temperature of from about 80 degrees Fahrenheit to about 120 degrees Fahrenheit into a created cavern in the salt dome. The liquefied compressed natural gas is offloaded from the vessel to the storage cavern, wherein the liquefied compressed natural gas is at a pressure of from about 750 psi to about 1100 psi and a temperature of from about −80 degrees Fahrenheit to about −110 degrees Fahrenheit. The liquefied compressed natural gas is mixed with gas vapor in the storage cavern, wherein the gas vapor in the storage cavern is at a geostatic temperature and at a pressure lower than a pressure of the liquefied compressed natural gas.

17 Claims, 6 Drawing Sheets

METHOD FOR OFFLOADING AND STORAGE OF LIQUEFIED COMPRESSED NATURAL GAS

The present application claims priority to now abandoned U.S. Provisional Patent Application Ser. No. 60/508,892 filed on Oct. 6, 2003.

FIELD

The present embodiments relate to a method for storing high pressure, compressed natural gas in a salt dome.

BACKGROUND

The current art teaches that liquefied natural gas (LNG) can be stored in a variety of vessels and tanks. Compressed natural gas (CNG) can be stored in higher pressure rated tanks. Problems exist in current storage processes for small vessels that have to travel long distances. A need exists for storage sites underground that provide access to the CNG and also protect the CNG itself.

Compressed natural gas can be transported by way of a barge or above deck on a ship. CNG is typically cooled to a temperature around −75 degrees Fahrenheit at a pressure of around 1150 psi. The CNG is placed into strong, pressure vessels contained within an insulated cargo hold of a ship. Cargo refrigeration facilities are not usually provided aboard the ship even though the cargo is cool. A disadvantage of these ships is that they only travel short distances. If the distance to be traveled is long, the ship must not be delayed in unloading, or else the CNG bleeds off and the shipment is wasted. Current CNG storage systems have the problem of dealing with the inevitable expansion of gas in a safe manner as the gas warms during transport.

A need exists, therefore, for compressed natural gas storage systems that can contain large quantities at intermediate points on an itinerary, or at a remote location that contains refrigeration or sophisticated CNG containment systems.

SUMMARY

The methods are for offloading and storage of liquefied compressed natural gas. The methods include identifying a salt dome, installing a platform over the salt dome, constructing a storage cavern in the salt dome, and inserting piping into the storage cavern. The method further involves connecting piping to a platform offloading manifold disposed on the platform, using a flexible offloading conduit with a platform end connected to the platform offloading manifold and a vessel end connected to a vessel offloading manifold located on a vessel. The method continues by connecting the vessel offloading manifold to a transport container of liquefied compressed natural gas disposed on the vessel.

The method further includes using a flexible displacement gas conduit with a displacement platform end connected to a displacement gas platform manifold located on the platform and a displacement vessel end connected to a displacement gas vessel manifold located on the vessel. The displacement gas has a pressure greater than a pressure of the liquefied compressed natural gas and a temperature of from about 80 degrees Fahrenheit to about 120 degrees Fahrenheit. Next, the method involves connecting the displacement gas vessel manifold to the transport containers and offloading the displacement gas from the transport containers.

The method ends by flowing the displacement gas from a source into the transport container to initiate offloading of the liquefied compressed natural gas from the vessel to the storage cavern. The liquefied compressed natural gas is at a pressure of from about 750 psi to about 1100 psi and a temperature of from about −80 degrees Fahrenheit to about −110 degrees Fahrenheit. The liquefied compressed natural gas is mixed with the gas vapor in the storage cavern. The gas vapor in the storage cavern is at a geostatic temperature and at a pressure lower than a pressure of the liquefied compressed natural gas.

BRIEF DESCRIPTION OF THE DRAWINGS

The present method will be explained in greater detail with reference to the appended Figures, in which.

The present method is detailed below with reference to the listed Figures.

DETAILED DESCRIPTION OF THE PREFERRED EMBODIMENTS

Before explaining the present method in detail, it is to be understood that the method is not limited to the particular embodiments herein and it can be practiced or carried out in various ways.

Methods for offloading, storage and loading of liquefied compressed natural gas are embodied herein.

Figure 1:
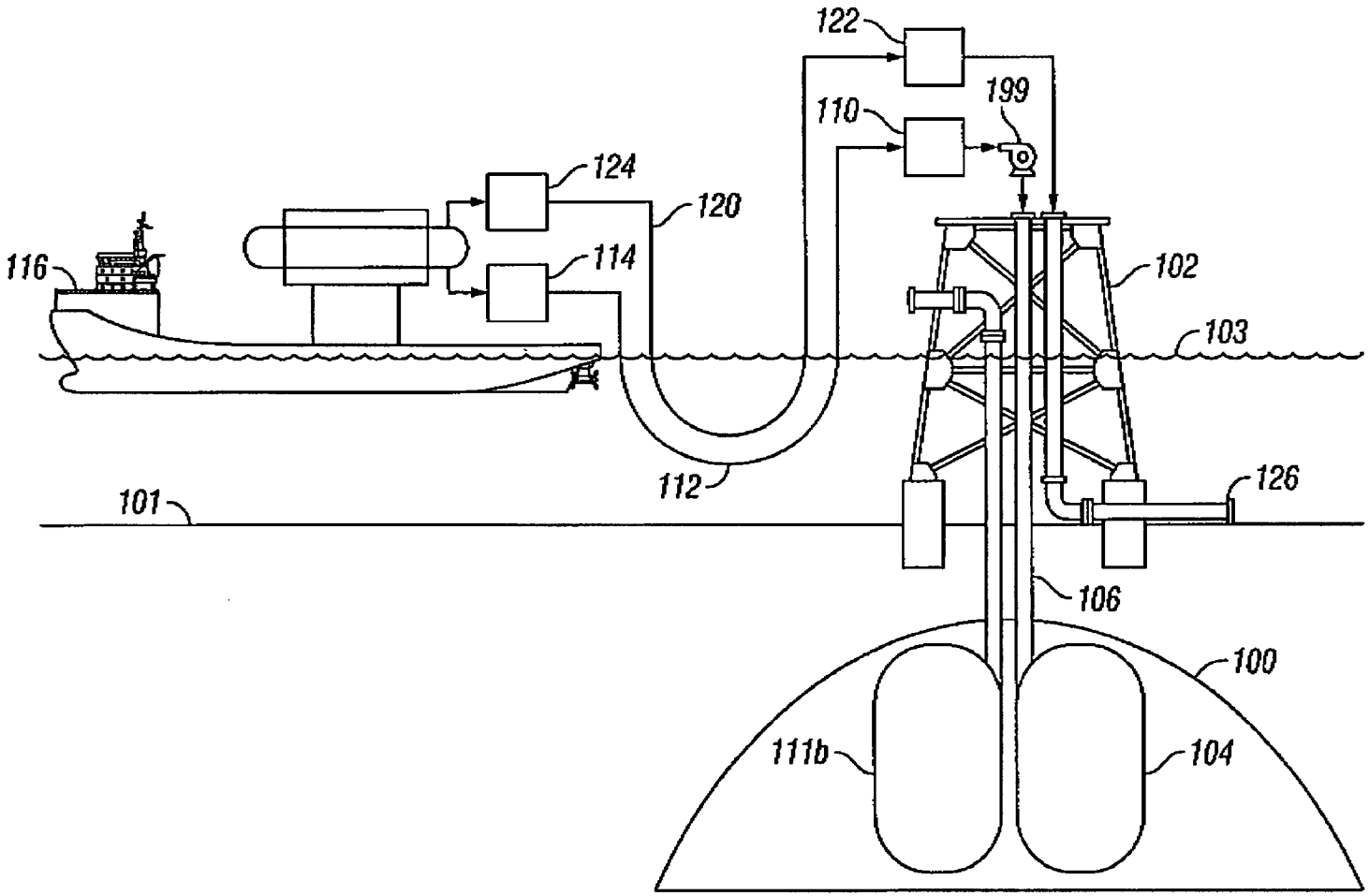
FIG. 1 depicts a side view of the salt dome and assembly as used in an embodiment of the method.

FIG. 1 depicts the equipment used in the method. As a first step of the method, a salt dome 100 is identified below a sea bed 101. A platform 102 is installed over the salt dome 100 extending above the surface of the water 103. A storage cavern 104 is formed in the salt dome 100 using conventional equipment and then piping 106 is installed into the storage cavern 104.

In one embodiment, the platform 102 includes a jacket and deck, but the platform 102 can be a jack up rig, a fixed leg platform, a tension leg platform, a Spar™, a floating platform, a floating vessel or a drill ship or another variation of this type of support structure.

Additional equipment for use in the method includes a platform offloading manifold 110 disposed on the platform 102 for connecting piping 106 to the platform 102. A flexible offloading conduit 112 with a platform end connected to the platform offloading manifold and a vessel end connected to a vessel offloading manifold 114. The vessel offloading manifold 114 is located on a vessel 116. The vessel offloading manifold 114 is in fluid communication with a transport container 118 holding two phase liquefied compressed natural gas. The transport container 118 is also referred to as the storage element in this method. The transport container is disposed on the vessel 116. A plurality of storage elements or transport containers can be used on any floating transport vessel.

The flexible displacement gas conduit 120 has a displacement platform end connected to a displacement gas platform manifold 122 located on the platform 102. The flexible displacement gas conduit also has a displacement vessel end that is connected to a displacement gas vessel manifold 124 located on the vessel 116. Displacement gas is kept at a pressure greater than the pressure of the liquefied compressed natural gas in the transport container 118. The displacement gas is maintained at a temperature ranging from about 80 degrees Fahrenheit to about 120 degrees Fahrenheit.

Figure 1A:
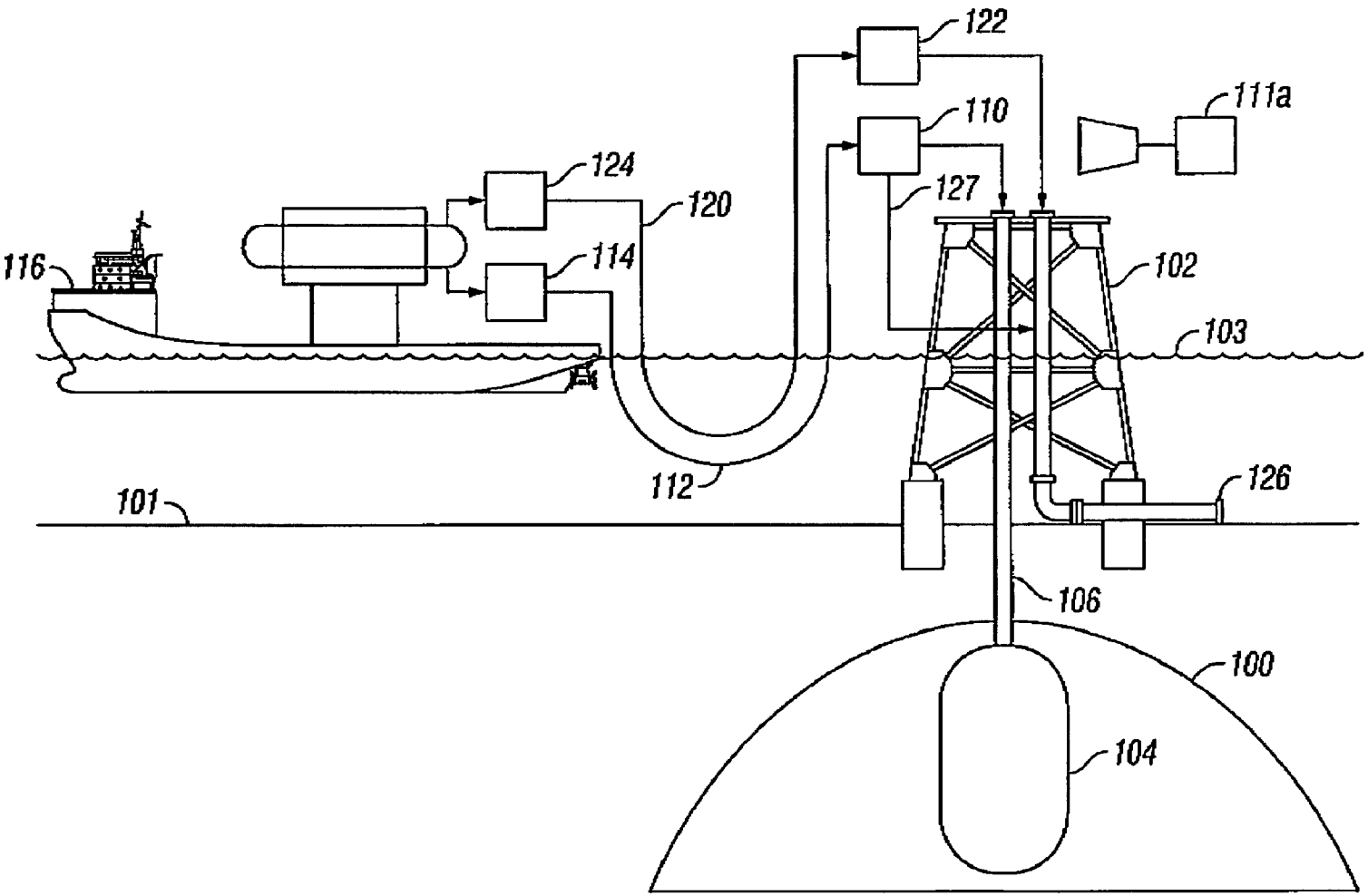
FIG. 1*a* depicts a second embodiment of FIG. 1.

In one embodiment, the transport container 118 has a top end and a bottom end with a displacement gas vessel manifold 124 connected to the top end and a vessel offloading manifold 114 connected to the bottom end, as shown in FIG. 1 and FIG. 1*a*.

The displacement gas flows from a source 126. The source 126 can be a pipeline or another storage cavity in the salt dome. The displacement gas flows into the transport container 118 to initiate offloading of the liquefied compressed natural gas from the vessel 116 to the storage cavern 104. The liquefied compressed natural gas is kept at a pressure of from about 750 psi to about 1100 psi and at a temperature of from about −80 degrees Fahrenheit to about −110 degrees Fahrenheit.

The method involves mixing the cold liquefied compressed natural gas with warm gas vapor in the storage cavern 104. The gas vapor in the storage cavern 104 is contemplated to be at a geostatic temperature and at a pressure lower than the pressure of the liquefied compressed natural gas. The cold liquefied compressed natural gas is introduced via the piping 106 into the top of the storage cavern 104. Since the cold liquefied compressed natural gas is denser than the vapor in the storage cavern, the cold liquefied compressed natural gas cascades, rains, or precipitates down through the cavern towards the bottom of the storage cavern 104. As the cold liquefied compressed natural gas descends, the gas mixes with the warm gas vapor. The cavern is sized to provide an inventory of warm gas vapor such that the temperature after the intimate mixing will be within the thermo elastic limits of the storage cavern 104.

Figure 5:
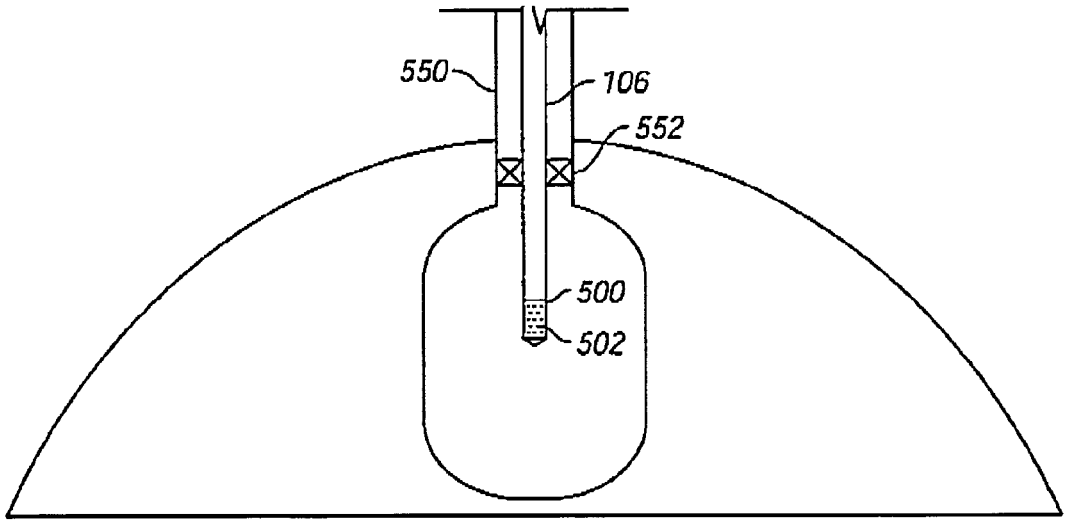
FIG. 5 depicts an atomizer engaged with the piping used in the method.

In one embodiment, the storage cavern includes using an atomizer 500 (see, FIG. 5 and FIG. 5*a*) within the storage cavern 104 to facilitate intimate mixing of the liquefied compressed natural gas with the gas vapor in the storage cavern 104. As shown in both FIG. 5 and FIG. 5*a*, the atomizer 500 is connected to piping 106 and is surrounded by casing 550. The atomizer 500 is held in place using a packer 552 as shown in FIG. 5.

Figure 5A:
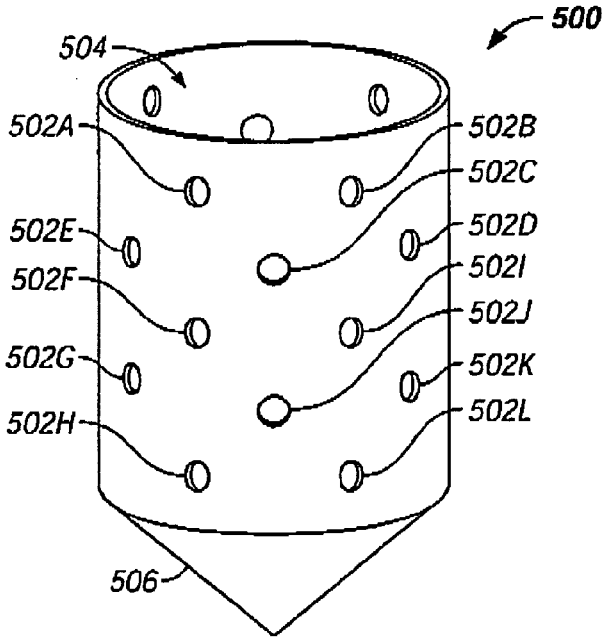
FIG. 5*a* depicts a preferred embodiment of an atomizer usable in an embodiment of the method.

The atomizer 500 includes a plurality of orifices 502A, 502B, 502C, 502D, 502E, 502F, 502G, 502H, 5021, 502J, 502K, and 502L formed in a conduit 504, as shown in FIG. 5*a*. The plurality of orifices is configured to disperse the liquefied compressed natural gas. The plurality of orifices 502 can have the same diameter or varying diameters depending on the offloading rate of the gas and well bore configuration. Further, the plurality of orifices 502 can be formed in a random pattern in the conduit or in a predetermined arrangement. In one embodiment, one end 506 of the conduit 504 is closed so that the liquefied natural gas does not flow out of the end and therefore, is forced to be dispersed through the orifices.

Following intimate mixing of the cold gas with the warm vapor, the now cool two part mix increases as heat is absorbed from the cavern walls. The expansion and pressure increases in the salt dome as the temperature increases. The stress is relieved by venting gas from the storage cavern through line 127 into gas pipeline 126. The method further includes flowing the compressed natural gas from the storage cavern 104 to a natural gas pipeline 126. The natural gas pipeline 126 can also act as the source of the displacement gas via another line 127 from the manifold 110, as shown in FIG. 1*a*.

In another embodiment, the method further includes pumping the compressed natural gas from the vessel 116 to the salt dome 100 through the piping 106 using a pump 199, as shown in FIG. 1.

In still another embodiment, the compressed liquefied natural gas is kept at a pressure of from about 900 psi to about 1000 psi prior to being inserted into the piping 106. In another embodiment, the displacement gas is a natural gas from a pipeline network or a natural gas from another storage cavern.

The method shown with the assembly of FIG. 1 or FIG. 1*a* contemplates offloading the displacement gas from the transport containers 118. For example, the offloading of the displacing gas can include shutting off the displacement gas at source 126 or connecting the platform offloading manifold 110 to a low pressure sink 111*b*. The low pressure sink in the embodiment of FIG. 1 is contemplated to be a part of the salt dome 100.

The next step involves flowing displacement gas from the transport container 118 through the flexible offloading conduit 112 to the low pressure sink until the pressure in the transport container 118 approaches a residual pressure. The low pressure sink is then shut off to terminate offloading of the displacement gas. In another embodiment shown in FIG. 1*a*, the low pressure sink is a compressor suction 111*a*.

In one embodiment, the residual pressure of the compressed natural gas provides sufficient inventory of residual natural gas to power the vessel 116.

Figure 2:
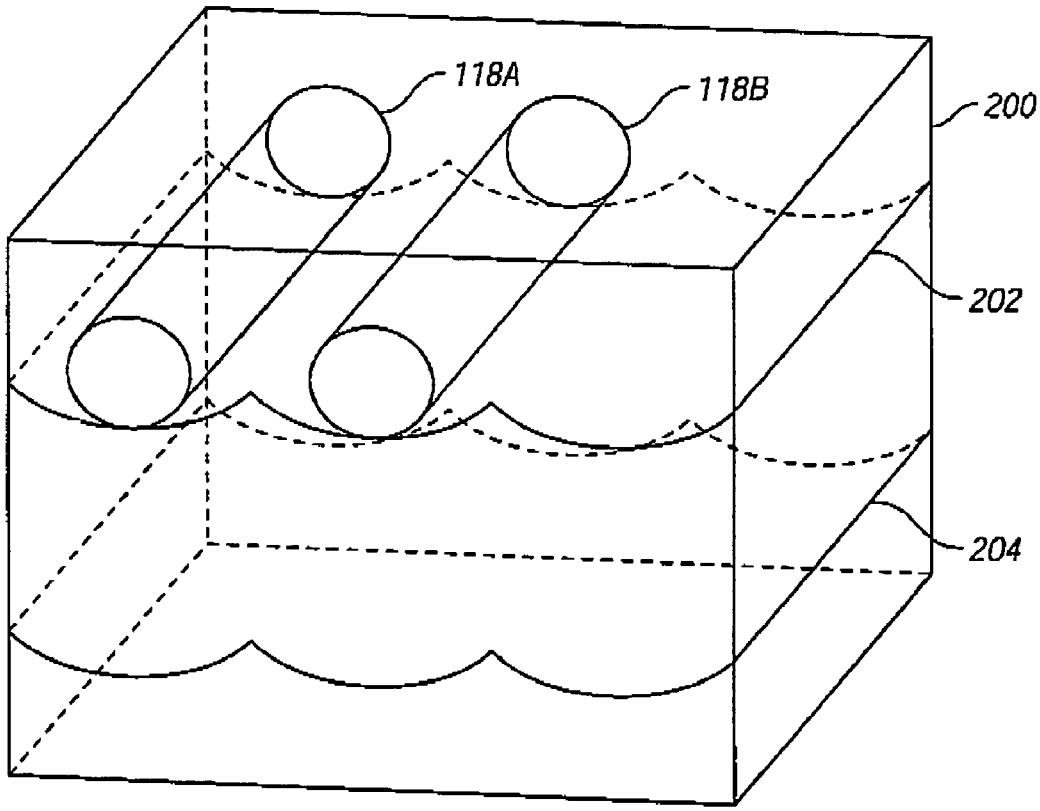
FIG. 2 depicts a storage module usable in an embodiment of the method.

FIG. 2 illustrates an embodiment where a plurality of transport containers 118A and 118B (or storage elements) is further grouped into modules 200 and each module includes a first structural frame including a first stanchion 202 and a second stanchion 204. The modules 200 further include a second structural frame (not shown) including a third stanchion and a fourth stanchion. The modules 200 also include a skid shoe (not shown) disposed on each stanchion, a first rack (not shown) connecting the first stanchion 202 and the second stanchion 204 and at least a second rack (not shown) connecting the third stanchion and the fourth stanchion. The transport containers are disposed in the first rack 202 and the second rack 204.

In the preferred embodiment, the transport containers are double walled, having a load bearing inner wall, a protective outer wall and insulation disposed between the wall.

Figure 3:
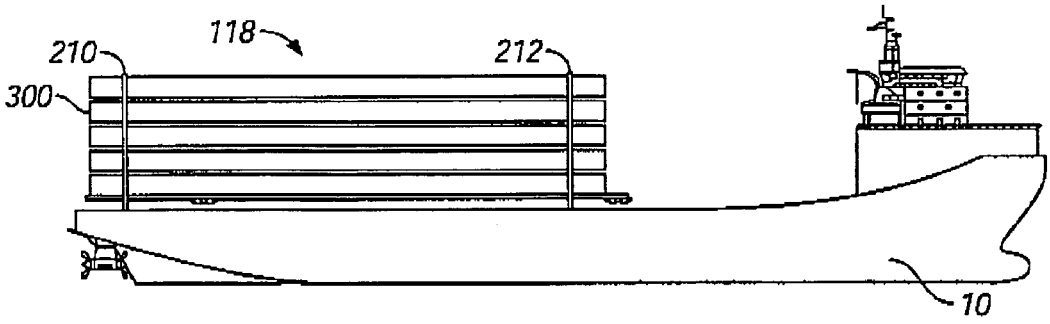
FIG. 3 depicts a side view of the storage module located on a floating vessel.
Figure 3A:
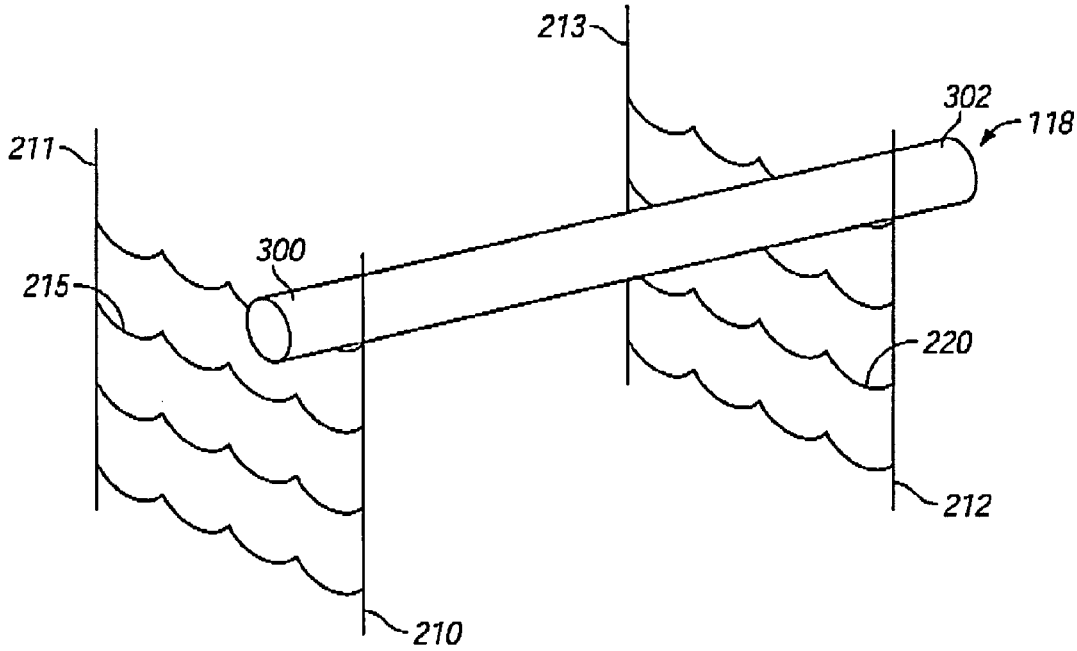
FIG. 3*a* depicts a perspective view of one rack and two stanchions of the storage module.

As shown in FIG. 3 and FIG. 3*a*, the storage module is made of a first structural frame 210 with two stanchions 212 and 214 and a second structural frame 220 with two stanchions 222 and 224. Each stanchion has a skid shoe 216, 218, 226, and 228. The skid shoe mountings allow the module to be transported from land to a floating vessel 10 easily. A first rack 215 connects the first and second stanchions 210 and 211. A second rack 225 connects the third and fourth stanchions 212 and 213.

Each storage module holds one or more storage elements 100. The storage elements have a first end 135 and a second end 140. An individual storage element 100 is shown in FIG.

4. The storage element 100 has an inner wall 105 forming a cavity 110, an outer wall 115, and an insulation layer 120 located between the inner wall 105 and outer wall 115. The cavity 110 is designed to hold compressed cooled natural gas, natural gas liquid, and condensate.

Returning to FIG. 3 and FIG. 3*a*, the first end 135 of the storage element is supported in the first rack 215 and the second end 140 is supported in the second rack 225.

The storage module supports between three and fifteen storage elements. The weight of the storage module when loaded with at least one empty storage element ranges from about 5000 short tons to about 8000 short tons.

The structural frame can support up to five racks between the first and second stanchions and up to five racks between the third and fourth stanchions.

The first and second racks can support up to five transport containers. The rack can further include a plate supported by a plurality of ridges for removably holding the transport containers. The rack can be structurally anchored. The second end, or unanchored end, is allowed to travel or move to accommodate thermal strain.

The transport container's empty weight ranges from about 350 short tons to about 700 short tons when loaded. Each transport container can have a length up to about 350 feet.

Returning to FIG. 4, the storage elements have the outer wall 115 thinner than the inner wall 105, since the outer wall 115 is not designed to be load bearing. The outer wall 115 can be steel, stainless steel, aluminum, thermoplastic, fiberglass, or combinations thereof. Stainless steel is preferred since stainless steel reduces radiant heat transfer and is fire-resistant and corrosion-resistant.

The construction material for the inner wall 105 is a high-strength steel alloy, such as a nickel-steel alloy. The construction material for the inner wall could be a basalt-based fiber pipe.

Figure 4A:
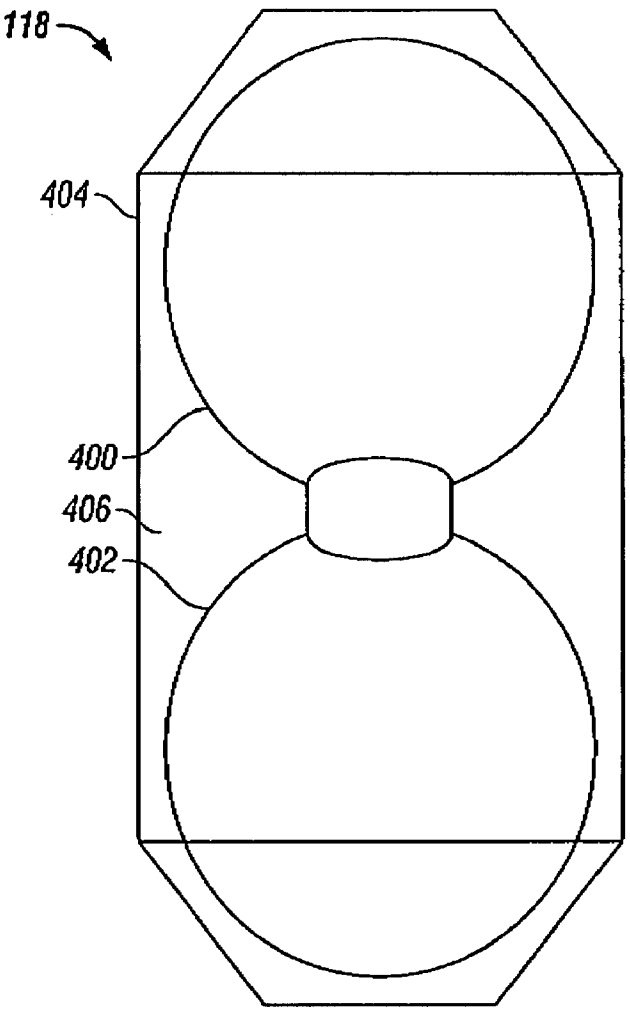
FIG. 4*a* depicts the spherical shape embodiment of the storage element.
Figure 4:
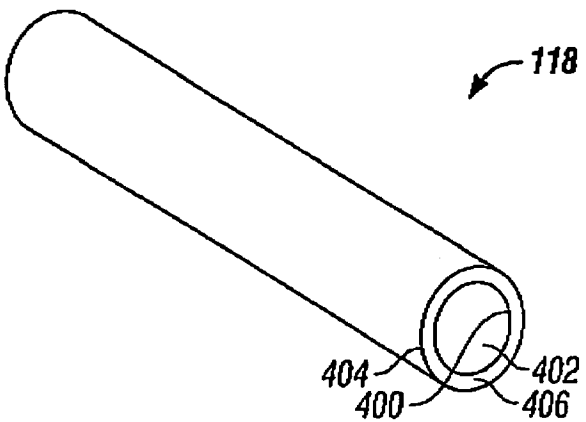
FIG. 4 depicts the cylindrical shape embodiment of the storage element.

The shape of the storage element can either be cylindrical or spherical. The cylindrical shape, as shown in FIG. 4, is a preferred embodiment. The inner wall 105 has a diameter ranging from about 8 feet to about 15 feet with a preferred range from about 10 feet to about 12 feet. The outer wall 115 has a diameter that is up to four feet larger in diameter than the inner wall. FIG. 4*a* depicts the spherical embodiment of the storage element.

For the spherical shape, the inner wall has a diameter ranging from about 30 feet to about 40 feet. The outer wall has diameter that is up to three feet larger in diameter than the inner wall.

The insulating layer can be perlite.

The method includes identifying a salt dome, installing a platform over the salt dome, constructing a storage cavern in a salt dome and inserting piping into the storage cavern.

The method further includes connecting piping to a platform offloading manifold disposed on the platform, using a flexible offloading conduit with a platform end connected to the platform offloading manifold and a vessel end connected to a vessel offloading manifold located on a vessel, and connecting the vessel offloading manifold to a transport container of liquefied compressed natural gas disposed on the vessel.

The method further includes using a flexible displacement gas conduit including a displacement platform end connected to a displacement gas platform manifold located on the platform, and a displacement vessel end connected to a displacement gas vessel manifold located on the vessel and wherein the displacement gas has a pressure greater than the liquefied compressed natural gas and a temperature of from about 80 degrees Fahrenheit to about 120 degrees Fahrenheit.

The method further includes connecting the displacement gas vessel manifold to the transport container and offloading the displacement gas from the transport containers.

The method includes flowing the displacement gas from a source into the transport container to initiate offloading of the liquefied compressed natural gas from the vessel to the storage cavern, wherein the liquefied compressed natural gas is at a pressure of from about 750 psi to about 1100 psi and a temperature of from about −80 degrees Fahrenheit to about −110 degrees Fahrenheit and mixing the liquefied compressed natural gas with gas vapor in the storage cavern, wherein the gas vapor in the storage cavern is at a geostatic temperature and at a pressure lower than a pressure of the liquefied compressed natural gas.

While these embodiments have been described with emphasis on the preferred embodiments, it should be understood that within the scope of the appended claims these embodiments might be practiced other than as specifically described herein.

What is claimed is:

1. A method for offloading and storage of liquefied compressed natural gas, wherein the method comprises the steps of:

a. identifying a salt dome;

b. installing a platform over the salt dome;

c. constructing a storage cavern in the salt dome;

d. inserting piping into the storage cavern;

e. connecting piping to a platform offloading manifold disposed on the platform;

f. using a flexible offloading conduit comprising a platform end connected to the platform offloading manifold and a vessel end connected to a vessel offloading manifold located on a vessel;

g. connecting the vessel offloading manifold to a transport container of liquefied compressed natural gas disposed on the vessel;

h. using a flexible displacement gas conduit including a displacement platform end and a displacement vessel end, wherein the displacement platform end is connected to a displacement gas platform manifold located on the platform, wherein the displacement vessel end is connected to a displacement gas vessel manifold located on the vessel, and wherein the displacement gas comprises a pressure greater than a pressure of the liquefied compressed natural gas and a temperature of from about 80 degrees Fahrenheit to about 120 degrees Fahrenheit;

i. connecting the displacement gas vessel manifold to the transport container;

j. flowing the displacement gas from the source into the transport container to initiate offloading of the liquefied compressed natural gas from the vessel to the storage cavern, wherein the liquefied compressed natural gas is at a pressure of from about 750 psi to about 1100 psi and a temperature of from about −80 degrees Fahrenheit to about −110 degrees Fahrenheit; and k. mixing the liquefied compressed natural gas with gas vapor in the storage cavern, wherein the gas vapor in the storage cavern is at a geostatic temperature and at a pressure lower than a pressure of the liquefied compressed natural gas.

2. The method of claim 1, further comprising the step of using an atomizer within the storage cavern to facilitate intimate mixing of the liquefied compressed natural gas with the gas vapor in the storage cavern.

3. The method of claim 1, further comprising the step of flowing the compressed natural gas from the storage cavern to a natural gas pipeline.

4. The method of claim 1, further comprising pumping the compressed natural gas from the vessel to the salt dome through the piping.

5. The method of claim 1, wherein the platform is selected from the group consisting of a jacket, a jack up rig, a fixed leg platform, a tension leg platform, a Spar, a floating platform, a floating vessel, and a drill ship.

6. The method of claim 1, wherein the compressed liquefied natural gas is at a pressure from about 900 psi to about 1000 psi prior to being inserted into the piping.

7. The method of claim 1, wherein the displacement gas is a natural gas from a pipeline network or a natural gas from another storage cavern.

8. The method of claim 1, wherein the transport container comprises a top end and a bottom end and the displacement gas vessel manifold connects to the top end and the vessel offloading manifold connects to the bottom end.

9. The method of claim 1, further comprising the step of offloading the displacement gas from the transport containers.

10. The method of claim 9, wherein the step of offloading the displacement gas comprises:

a. shutting of the displacement gas from a source;

b. connecting the platform offloading manifold to a low pressure sink;

c. flowing displacement gas from the transport container through the flexible offloading conduit to the low pressure sink until pressure in the transport container approaches a residual pressure; and d. shutting off the low pressure sink to terminate offloading of the displacement gas.

11. The method of claim 10, wherein the low pressure sink is a second storage cavity or a salt dome cavern.

12. The method of claim 10, wherein low pressure sink comprises a suction compressor.

13. The method of claim 10, wherein the residual pressure provides sufficient inventory of residual natural gas to power the vessel.

14. The method of claim 1, wherein from about 16 to about 64 transport containers are disposed on the vessel.

15. The method of claim 1, wherein a plurality of transport containers is further grouped into modules and each module comprises:

a. a first structural frame including a first stanchion and a second stanchion;

b. a second structural frame including a third stanchion and a fourth stanchion;

c. a skid shoe disposed on each stanchion;

d. a first rack connecting the first stanchion and the second stanchion; and e. at least a second rack connecting the third stanchion and the fourth stanchion, wherein the transport containers are disposed in the first rack and the second rack.

16. The method of claim 1, wherein the transport containers are double walled.

17. The method of claim 1, wherein a plurality of manifolds and a plurality of flexible conduits are used with the transport container, source and storage cavern.

* * * * *